US007364040B1

(12) United States Patent
Hunter et al.

(10) Patent No.: US 7,364,040 B1
(45) Date of Patent: Apr. 29, 2008

(54) TRUSS SUPPORTED/TOOL SUPPORTING SYSTEM

(76) Inventors: Robert M. Hunter, 9916 Mark Twain La., Port Richey, FL (US) 34668; John B. Reinhard, 10350 Wood Duck Dr., New Port Richey, FL (US) 34654

( * ) Notice: Subject to any disclaimer, the term of this patent is extended or adjusted under 35 U.S.C. 154(b) by 468 days.

(21) Appl. No.: 10/949,762

(22) Filed: Sep. 24, 2004

(51) Int. Cl.
*B65D 85/00* (2006.01)
*B65D 85/20* (2006.01)

(52) U.S. Cl. ..... 206/350; 206/349; 206/373; 206/818

(58) Field of Classification Search ..... 206/350, 206/349, 818, 378, 478, 477, 479, 480, 373; 335/285; 211/70.6, 69
See application file for complete search history.

(56) References Cited

U.S. PATENT DOCUMENTS 3,228,133 A * 1/1966 Baermann ..... 40/621
3,827,021 A * 7/1974 Phelon ..... 335/285
4,714,158 A * 12/1987 Oltman et al. ..... 206/349
5,529,184 A * 6/1996 Sadow ..... 206/320
5,544,747 A * 8/1996 Horn ..... 206/378
5,743,394 A * 4/1998 Martin ..... 206/378
5,760,668 A * 6/1998 Testa et al. ..... 335/285
5,848,694 A * 12/1998 Newton ..... 206/373
5,988,382 A * 11/1999 Ritchie et al. ..... 206/372
6,719,155 B1 * 4/2004 Chang ..... 211/70.6
6,923,317 B2 * 8/2005 Coleman et al. ..... 206/350
7,080,733 B2 * 7/2006 Kao ..... 206/372
7,190,248 B2 * 3/2007 Coleman et al. ..... 335/285
2004/0159578 A1 * 8/2004 Lieffring et al. ..... 206/557

* cited by examiner

*Primary Examiner*—Mickey Yu
*Assistant Examiner*—Steven A. Reynolds

(57) ABSTRACT

A container has a top and bottom face with a plurality of rectilinear recesses formed in the top face. A plurality of rectilinear magnets are sized and shaped to fit snugly within the recesses with their upper faces. The magnets are essentially coextensive with the upper face of the container. A handle extends upwardly from the upper surface of the container. A pair of spaced parallel cleats extend downwardly from the lower surface of the container.

2 Claims, 3 Drawing Sheets

FIG 1
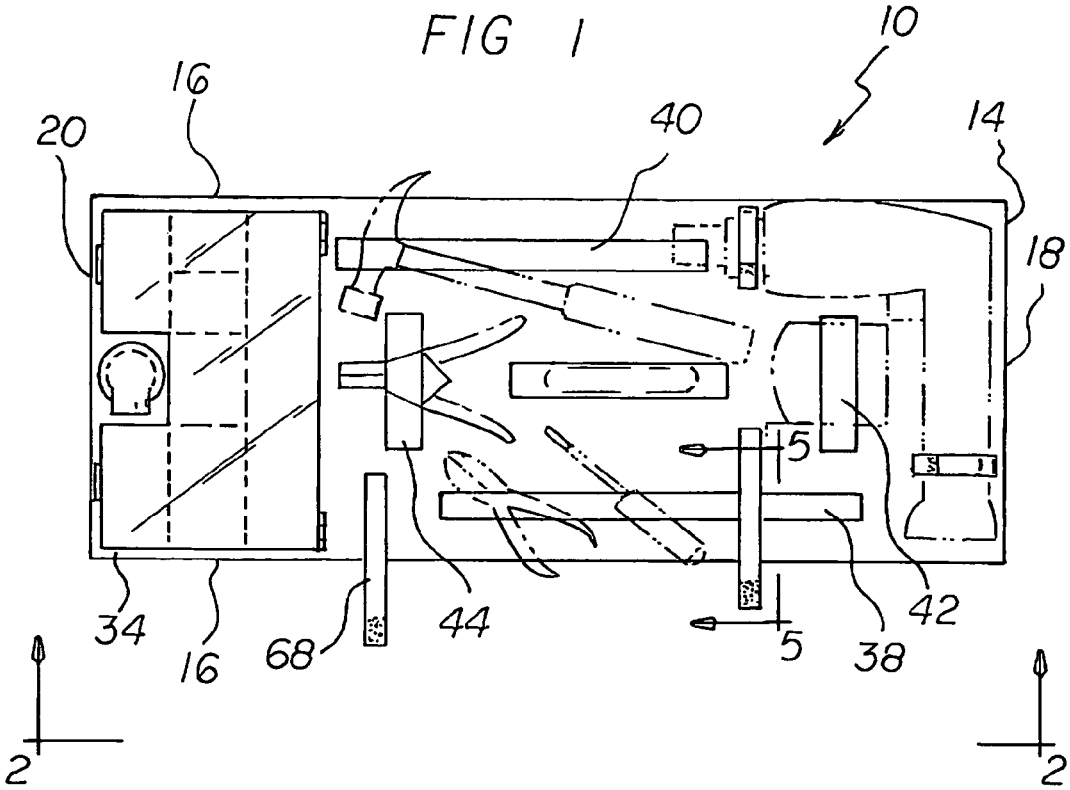
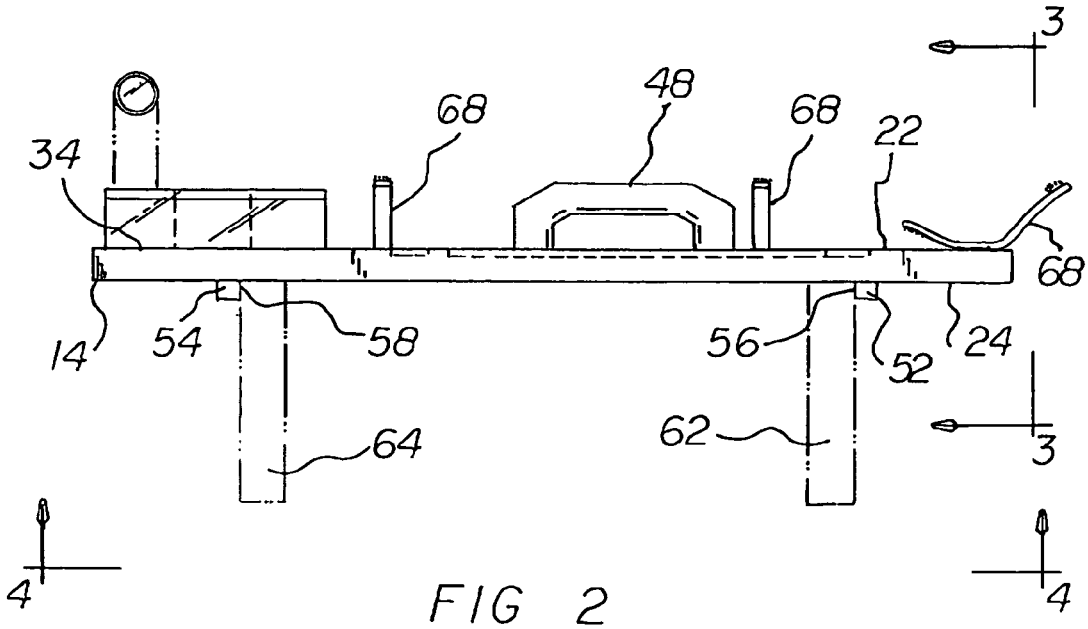
FIG 2

FIG 3
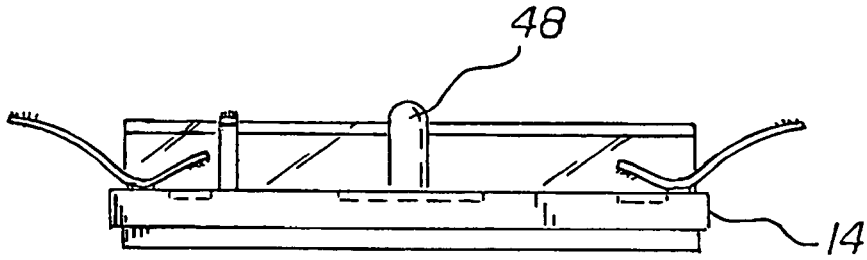
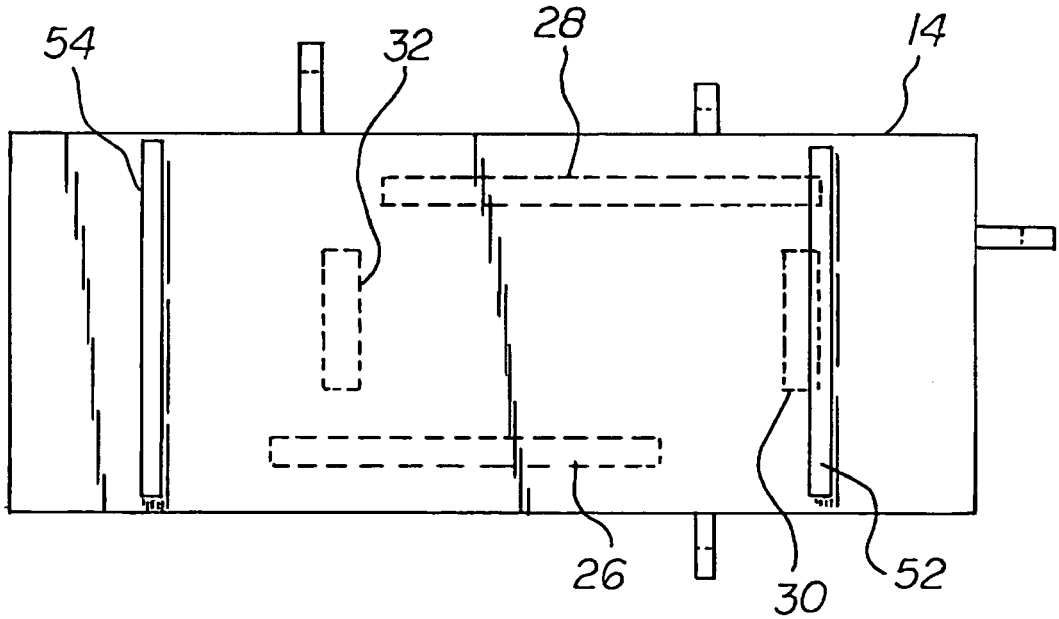
FIG 4

FIG 5
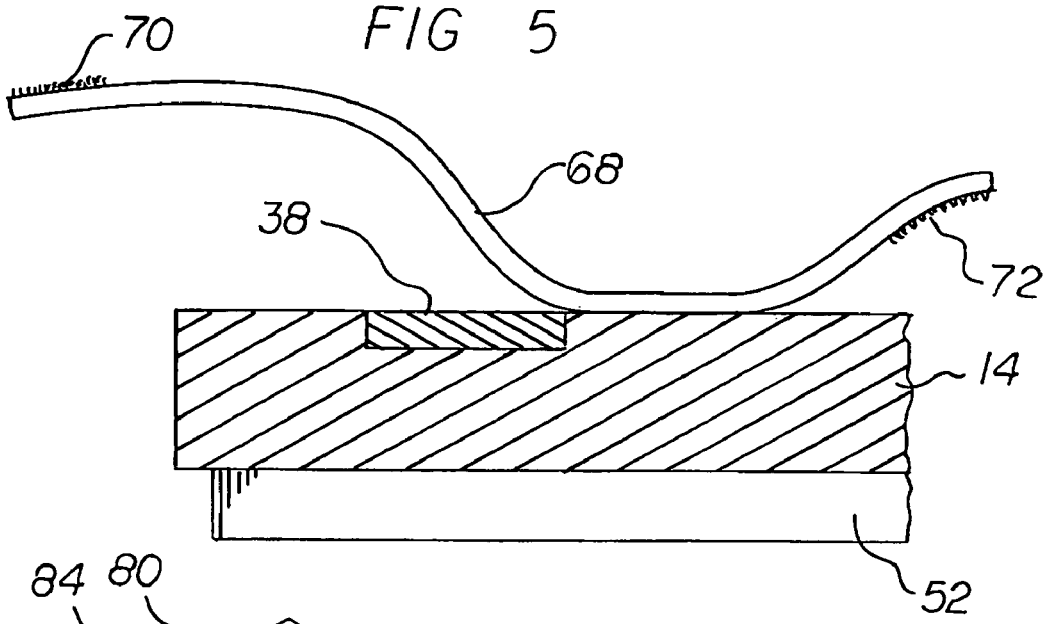
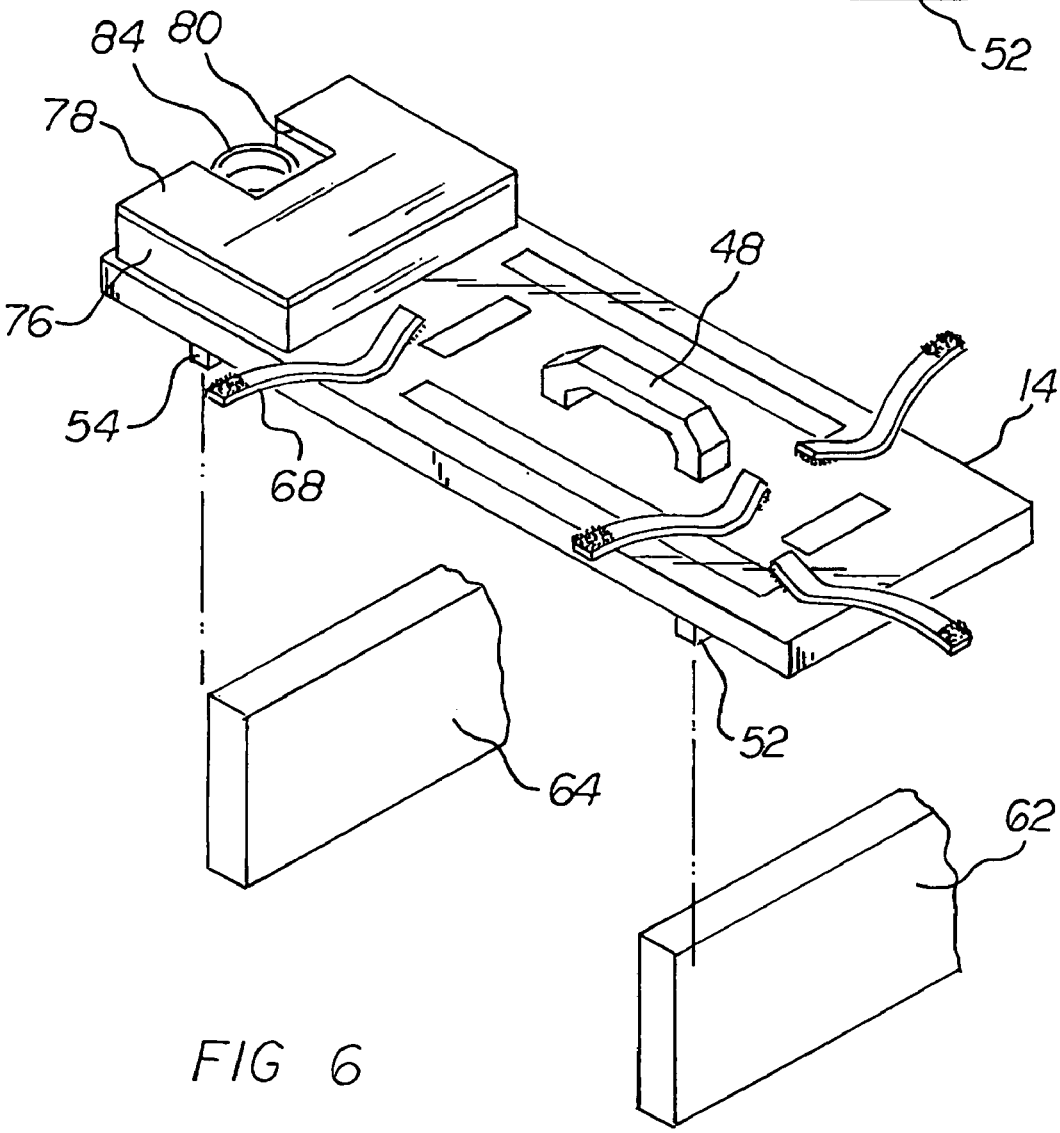
FIG 6

TRUSS SUPPORTED/TOOL SUPPORTING SYSTEM

BACKGROUND OF THE INVENTION

1. Field of the Invention

The present invention relates to a truss supported/tool supporting system and more particularly pertains to retaining tools in a convenient accessible orientation at a fixed confined space.

2. Description of the Prior Art

The use of tool holders of known designs and configurations is known in the prior art. More specifically, tool holders of known designs and configurations previously devised and utilized for the purpose of retaining tools through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,565,624 issued Aug. 28, 1951 to Phelon relates to a holder for articles of magnetic material. U.S. Pat. No. 4,048,924 issued Sep. 20, 1977 to Wibben relates to a roofing system. U.S. Pat. No. 5,148,890 issued Sep. 22, 1992 to Sipe relates to a portable utility platform unit. U.S. Pat. No. 5,301,822 issued Apr. 12, 1994 to Coleman relates to a magnetic tool holder. U.S. Pat. No. 5,760,668 issued Jun. 2, 1998 to Testa relates to a magnetic tool and object holder. Lastly, U.S. Pat. No. 6,708,856 issued Mar. 23, 2004 to Yamamoto relates to a automotive tool tray and support assembly.

While these devices fulfill their respective, particular objectives and requirements, the aforementioned patents do not describe truss supported/tool supporting system that allows retaining tools in a convenient accessible orientation at a fixed confined space.

In this respect, the truss supported/tool supporting system according to the present invention substantially departs from the conventional concepts and designs of the prior art, and in doing so provides an apparatus primarily developed for the purpose of retaining tools in a convenient accessible orientation at a fixed confined space.

Therefore, it can be appreciated that there exists a continuing need for a new and improved truss supported/tool supporting system which can be used for retaining tools in a convenient accessible orientation at a fixed confined space. In this regard, the present invention substantially fulfills this need.

SUMMARY OF THE INVENTION

In view of the foregoing disadvantages inherent in the known types of tool holders of known designs and configurations now present in the prior art, the present invention provides an improved truss supported/tool supporting system. As such, the general purpose of the present invention, which will be described subsequently in greater detail, is to provide a new and improved truss supported/tool supporting system and method which has all the advantages of the prior art and none of the disadvantages.

To attain this, the present invention essentially comprises a container. The container is in a rectilinear configuration. The container has two parallel longer side edges. The side edges are about 36 inches in length. The container has shorter parallel front and rear edges. The front and rear edges are about 12 inches in width. The front and rear edges are provided between the side edges. The container has a top face and a bottom face. A plurality of rectilinear recesses are formed in the top face. The recesses include two longer side recesses. The two longer side recesses are parallel with and adjacent to the side edges. Shorter front recess are provided. The shorter front recesses are parallel with and adjacent to the front edge. A shorter rear recess is provided. The shorter rear recess is parallel with and spaced from the rear edge. In this manner a planar space is created between the rear recess and the rear edge. The container is fabricated of a rigid non-magnetic material selected from the class of rigid non-magnetic materials including wood and plastic.

A plurality of rectilinear magnets are provided. The magnets include two larger side magnets and two smaller front and rear magnets. The magnets are sized and shaped to fit snugly within the recesses. The magnets have upper faces. The upper faces are essentially coextensive with the upper face of the container. In this manner a magnetically responsive tool may be placed upon the upper surface of the container by a user and then be retained in the retained location by an attractive forces of a magnet until the user grabs and removes the tool. Representative tools are shown in FIG. 1 in dashed lines.

Provided next is a handle. The handle extends upwardly from the upper surface of the container. The handle is located parallel with and midway between the side edges and the side magnets. The handle is located perpendicular to and midway between the front and rear magnets.

A pair of spaced parallel cleats are provided next. The cleats extend downwardly from the lower surface of the container. The cleats are spaced from and parallel with the front and rear edges. The cleats extend from a location adjacent to one side edge to a location adjacent to the other side edge. The cleats have interior surfaces located about 26 inches apart.

Next, joists are provided. The joists are formed of parallel beams. The beams are about 2 inches thick and about 24 inches between center lines. The cleats are adapted to receive the lower surface of the container between the cleats for supporting the container with the joists between the cleats for abating inadvertent shifting of the container during operation and use.

A plurality of flexible retention straps are provided. Each strap has opposite ends and upper and lower surfaces. Each strap has a first hook and pile fastener on one surface at one end. Each strap has a second hook and loop fastener on the other surface at the other end. Each strap is adhesively secured to the upper surface of the container. In this manner the fasteners of any strap may be coupled to secure a tool to the container and uncoupled to release a secured tool.

Further provided is a box. The box is in a generally rectilinear configuration. The box is secured to the upper surface of the container upon the planar space. The box is adapted to house tool-related elements. The box has a lid. The lid is adapted to removably cover the box. The box is shaped to include an indentation. The indentation is adjacent to the rear edge of the container.

Provided last is a power driven tool. The tool is removably positionable within the indentation. The tool is selected from the class of tools including flash lights, fans and the like.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved truss supported/tool supporting system which has all of the advantages of the prior art tool holders of known designs and configurations and none of the disadvantages.

It is another object of the present invention to provide a new and improved truss supported/tool supporting system which may be easily and efficiently manufactured and marketed.

It is further object of the present invention to provide a new and improved truss supported/tool supporting system which is of durable and reliable constructions.

An even further object of the present invention is to provide a new and improved truss supported/tool supporting system which is susceptible of a low cost of manufacture with regard to both materials and labor, and which accordingly is then susceptible of low prices of sale to the consuming public, thereby making such truss supported/tool supporting system economically available to the buying public.

Even still another object of the present invention is to provide a truss supported/tool supporting system for retaining tools in a convenient accessible orientation at a fixed confined space.

Lastly, it is an object of the present invention to provide a new and improved truss supported/tool supporting system. A container has a top and bottom face with a plurality of rectilinear recesses formed in the top face. A plurality of rectilinear magnets are sized and shaped to fit snugly within the recesses with their upper faces. The magnets are essentially coextensive with the upper face of the container. A handle extends upwardly from the upper surface of the container. A pair of spaced parallel cleats extend downwardly from the lower surface of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a truss supported/tool supporting system constructed in accordance with the principles of the present invention.

FIG. 2 is a front elevational view of the system taken along line 2-2 of FIG. 1.

FIG. 3 is a side elevational view of the system taken along line 3-3 of FIG. 2.

FIG. 4 is a bottom view of the system taken along line 4-4 of FIG. 2.

FIG. 5 is a cross sectional view taken along line 5-5 of FIG. 1.

FIG. 6 is an exploded perspective illustration of the system shown in the prior Figures.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved truss supported/tool supporting system embodying the principles and concepts of the present invention and generally designated by the reference numeral 10 will be described.

The present invention, the truss supported/tool supporting system 10 is comprised of a plurality of components. Such components in their broadest context include a container, a plurality of rectilinear magnets, a handle and a pair of spaced parallel cleats. Such components are individually configured and correlated with respect to each other so as to attain the desired objective.

First provided is a container 14. The container is in a rectilinear configuration. The container has two parallel longer side edges 16. The side edges are about 36 inches in length. The container has shorter parallel front and rear edges 18, 20. The front and rear edges are about 12 inches in width. The front and rear edges are provided between the side edges. The container has a top face 22 and a bottom face 24. A plurality of rectilinear recesses 26, 28, 30, 32 are formed in the top face. The recesses include two longer side recesses 26, 28. The two longer side recesses are parallel with and adjacent to the side edges. Shorter front recess 30 are provided. The shorter front recesses are parallel with and adjacent to the front edge. A shorter rear recess 32 is provided. The shorter rear recess is parallel with and spaced from the rear edge. In this manner a planar space 34 is created between the rear recess and the rear edge. The container is fabricated of a rigid non-magnetic material selected from the class of rigid non-magnetic materials including wood and plastic.

A plurality of rectilinear magnets 38, 40, 42, 44 are provided. The magnets include two larger side magnets 38, 40 and two smaller front and rear magnets 42, 44. The magnets are sized and shaped to fit snugly within the recesses. The magnets have upper faces. The upper faces are essentially coextensive with the upper face of the container. In this manner a magnetically responsive tool may be placed upon the upper surface of the container by a user and then be retained in the retained location by an attractive forces of a magnet until the user grabs and removes the tool. Representative tools are shown in FIG. 1 in dashed lines.

Provided next is a handle 48. The handle extends upwardly from the upper surface of the container. The handle is located parallel with and midway between the side edges and the side magnets. The handle is located perpendicular to and midway between the front and rear magnets.

A pair of spaced parallel cleats 52, 54 are provided next. The cleats extend downwardly from the lower surface of the container. The cleats are spaced from and parallel with the front and rear edges. The cleats extend from a location adjacent to one side edge to a location adjacent to the other side edge. The cleats have interior surfaces 56, 58 located about 26 inches apart.

Next, joists 62, 64 are provided. The joists are formed of parallel beams. The beams are about 2 inches thick and about 24 inches between center lines. The cleats are adapted to receive the lower surface of the container between the cleats for supporting the container with the joists between the cleats for abating inadvertent shifting of the container during operation and use.

A plurality of flexible retention straps 68 are provided. Each strap has opposite ends and upper and lower surfaces. Each strap has a first hook and pile fastener 70 on one surface at one end. Each strap has a second hook and loop fastener 72 on the other surface at the other end. Each strap is adhesively secured to the upper surface of the container. In this manner the fasteners of any strap may be coupled to secure a tool to the container and uncoupled to release a secured tool.

Further provided is a box 76. The box is in a generally rectilinear configuration. The box is secured to the upper surface of the container upon the planar space. The box is adapted to house tool-related elements. The box has a lid 78. The lid is adapted to removably cover the box. The box is shaped to include an indentation 80. The indentation is adjacent to the rear edge of the container.

Provided last is a power driven tool 84. The tool is removably positionable within the indentation. The tool is selected from the class of tools including flash lights, fans and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A truss supported/tool supporting system for retaining tools in a conveniently accessible orientation at a fixed confined space comprising, in combination:

a container in a rectilinear configuration having two parallel longer side edges of about 36 inches in length with shorter parallel front and rear edges of about 12 inches in width between the side edges, the container having a planar upper face and a bottom face with a plurality of rectilinear recesses formed in the upper face; the recesses include two longer side recesses parallel with and adjacent to the side edges and a shorter front recess parallel with and adjacent to the front edge and a shorter rear recess parallel with and spaced from the rear edge to create a planar space between the rear recess and the rear edge, the container being fabricated of a rigid non-magnetic material selected from the class of rigid non-magnetic materials including wood and plastic;

a plurality of rectilinear magnets including two larger side magnets and two smaller front and rear magnets sized and shaped to fit snugly within the recesses, the magnets having planar upper faces coextensive with the planar upper face of the container;

a plurality of magnetically responsive tools including a screw driver and a hammer adjacent to the larger magnets and a tape measure adjacent to the smaller magnets, the tools placed upon the upper face of the container by a user and then retained in the retained location by an attractive forces of a magnet until the user grabs and removes the tool;

a fixedly positioned handle extending upwardly from the upper face of the container, the handle being located parallel with and midway between the side edges and the side magnets, the handle being located perpendicular to and midway between the front and rear magnets;

a pair of fixedly positioned spaced parallel cleats extending downwardly from the bottom face of the container, the cleats being spaced from and parallel with the front and rear edges and extending from a location adjacent to one side edge to a location adjacent to the other side edge, the cleats being spaced about 26 inches apart;

said container capable of being placed on joists formed of parallel beams about 2 inches thick and about 24 inches between center lines adapted to receive the lower surface of the container between the cleats for supporting the container with the joists between the cleats for abating inadvertent shifting of the container during operation and use;

a plurality of flexible retention straps each with opposite ends and upper and lower surfaces, each strap having a first hook and pile fastener on one surface at one end and a second hook and loop fastener on the other surface at the other end, each strap having a central extent adhesively secured to the upper face of the container whereby the fasteners of any strap are coupled to secure a tool including a power drill to the container and uncoupled to release the secured tool, one of the straps being secured to the upper face adjacent to a central extent of a larger side magent and perpendicular thereto, one of the straps being secured to the upper face adjacent to a central extent of one of the large side magnets and perpendicular thereto;

a box in a generally rectilinear configuration secured to the upper face of the container upon the planar space, the box adapted to house tool-related elements with a lid adapted to removably cover the box, the box being shaped to include an indentation adjacent to the rear edge of the container; and a power driven tool removably positioned within the indentation, the tool being selected from the class of tools including flash lights and fans.

2. A truss supported/tool supporting system comprising:

a container having a planar upper face and a bottom face with a plurality of rectilinear recesses formed in the upper face;

a plurality of rectilinear magnets sized and shaped to fit snugly within the recesses, the magnets having planar upper faces coextensive with the upper face of the container and also including magnetically responsive tools including a screw driver, a hammer, a tape measure and a pliers placed upon the upper face of the container;

a fixedly positioned handle extending upwardly from the upper face of the container;

a pair of fixedly positioned spaced parallel cleats extending downwardly from the bottom face of the container;

a plurality of flexible retention straps each with opposite ends and upper and lower surfaces, each strap having a first fastener at one end and a second fastener on the other end, each strap being secured to the upper face of the container whereby the fasteners of any strap are coupled to secure a tool including a power drill to the container and uncoupled to release the secured tool; and a box in a generally rectilinear configuration secured to the upper face of the container, the box adapted to house tool-related elements with a lid adapted to removably cover the box, the box being shaped to include an indentation adjacent to one edge of the container and further including a power driven tool removably positionable within the indentation, the tool being selected from the class of tools including flash lights and fans.

* * * * *